US008713742B2

(12) United States Patent
Pellacini

(10) Patent No.: US 8,713,742 B2
(45) Date of Patent: May 6, 2014

(54) ENHANCED SPONGE MOP

(75) Inventor: Roberto Pellacini, Torrechiara Langhirano (IT)

(73) Assignee: The Libman Company, Arcola, IL (US)

( * ) Notice: Subject to any disclaimer, the term of this patent is extended or adjusted under 35 U.S.C. 154(b) by 239 days.

(21) Appl. No.: 13/191,133

(22) Filed: Jul. 26, 2011

(65) Prior Publication Data

US 2012/0222703 A1 Sep. 6, 2012

Related U.S. Application Data

(60) Provisional application No. 61/449,706, filed on Mar. 6, 2011.

(51) Int. Cl.
*A47L 13/12* (2006.01)
*A47L 13/146* (2006.01)

(52) U.S. Cl.
USPC ..... 15/116.2; 15/119.2

(58) Field of Classification Search
USPC ..... 15/116.1, 116.2, 119.1, 119.2; 294/100, 294/209, 210
See application file for complete search history.

(56) References Cited

U.S. PATENT DOCUMENTS 3,289,233 A * 12/1966 Smyth et al. ..... 15/116.1
D280,769 S 9/1985 Johnson et al.
4,552,476 A 11/1985 Heraty et al.
D302,759 S 8/1989 Batchelor
D334,263 S 3/1993 Torres
D389,625 S 1/1998 Feldman et al.
D401,702 S 11/1998 Berti
D410,783 S 6/1999 Camp et al.
6,026,530 A 2/2000 Camp, Jr.
6,061,863 A 5/2000 Chen
6,513,844 B1 * 2/2003 Hsu ..... 294/210
D480,564 S 10/2003 Petner
D497,228 S 10/2004 Berti
D497,229 S 10/2004 Berti
D497,230 S 10/2004 Berti
6,983,509 B2 * 1/2006 Lin ..... 15/119.2
D520,698 S 5/2006 Libman et al.
D531,367 S 10/2006 Hay
D544,161 S 6/2007 Weaver
D548,908 S 8/2007 Berti
7,260,864 B1 8/2007 Morad (Continued)

FOREIGN PATENT DOCUMENTS

EP 1142526 A1 10/2001

OTHER PUBLICATIONS

Office Action from U.S. Appl. No. 29/399,071, mailed Jan. 5, 2012.

*Primary Examiner* — Mark Spisich
(74) *Attorney, Agent, or Firm* — Banner & Witcoff, Ltd.

(57) ABSTRACT

An enhanced sponge mop is presented for extracting cleaning solution from a mop head. The enhanced sponge mop may include a mop block structure, a hinged connector, and a sponge structure. Also, a rod may be threaded through a mop handle and attached to the hinged connector on one end and a pressure applying member on the other end. When the pressure applying member is moved from one position to another, swivels located on the mop block structure may allow a sponge attached to the sponge structure to be wrung. In addition, the mop block structure may include rails that mate with teeth located on the hinged connector to give additional stability to the enhanced sponge mop.

17 Claims, 16 Drawing Sheets

(56) References Cited

U.S. PATENT DOCUMENTS

| | | | | |
|---|---|---|---|---|
| 7,555,803 | B2 | 7/2009 | Libman | |
| D606,270 | S | 12/2009 | Weis et al. | |
| D607,169 | S | 12/2009 | Weis et al. | |
| 7,748,074 | B2 | 7/2010 | Guizzi | |
| 2004/0187240 | A1 | 9/2004 | Berti et al. | |
| 2009/0139041 | A1 * | 6/2009 | Weis | 15/119.2 |

* cited by examiner

ENHANCED SPONGE MOP

CROSS-REFERENCE TO RELATED APPLICATIONS

This application claims priority to provisional application Ser. No. 61/449,706 filed on Mar. 6, 2011, the entire contents of which are herein incorporated by reference. This application is related to U.S. patent application Ser. No. 507590, filed Jun. 24, 1983, now U.S. Pat. No. 4,468,832, entitled "Refill Sponge Mop Assembly"; U.S. patent application Ser. No. 637307, filed Aug. 3, 1984, now U.S. Pat. No. 4,509,224, entitled "Refill Sponge Mop Assembly"; U.S. patent application Ser. No. 10/982,061, filed Nov. 4, 2004, published as US Patent Application Publication 20060090275, now abandoned, entitled "Sponge Mop Head Assembly"; U.S. patent application Ser. No. 507591, filed Jun. 24, 1983, now U.S. Pat. No. 4,468,830, entitled "Sponge Mop"; U.S. patent application Ser. No. 11/189,127, filed Jun. 25, 2005, now U.S. Pat. No. 7,520,018, entitled "Mop With Attached Wringer"; and U.S. patent application Ser. No. 10/698,307, filed Oct. 31, 2003, now U.S. Pat. No. 7,225,495, entitled "Mop With Attached Scrubber," all of which are herein incorporated by reference in their entirety.

BACKGROUND

Sponge mops are widely used for washing floors, windows, and walls. In general, a sponge mop includes a handle with a mop head that includes a sponge. The sponge is generally removable when damaged and/or dirty so that a new sponge refill can be installed and the mop reused.

It is desirable to periodically expel the water from a wet sponge of a sponge mop while in use. This is desirably done without wetting the hands, with little body bending, and without lifting the sponge substantially above the height of a pail or bucket of cleaning solution.

Accordingly, various sponge mops have been developed for applying pressure to the sponge to squeeze out the water or cleaning solution from a sponge mop. While previous techniques have had limited success, there exists a need for a robust yet simple methodology for a mopping system to routinely extract cleaning solution from a mop head.

SUMMARY

In light of the foregoing background, the following presents a simplified summary of the present disclosure in order to provide a basic understanding of some aspects of the invention. This summary is not an extensive overview of the invention. It is not intended to identify key or critical elements of the invention or to delineate the scope of the invention. The following summary merely presents some concepts of the invention in a simplified form as a prelude to the more detailed description provided below.

Aspects of the present disclosure are directed to a mop with a hinged connector with wing sections that are configured to rotate together to fold a mop sponge against itself to apply pressure to expel cleaning solution from the sponge.

Other aspects of the present disclosure are directed to a mop with a pressure applying member that may be easily reached to apply pressure to the wing sections of a mop to allow a mop sponge to be wringed.

Other aspects of the present disclosure are directed to a mop with a mop block structure with swivels that mate with a hinged connector to allow the hinged connector to move from an open wing position to a closed wing position, and vice versa.

Still other aspects of the present disclosure are directed to a hinged connector with teeth that mate with rails on a mop block structure to provide stability to the mop as the head moves from an open wing position to a closed wing position, and vice versa.

Aspects of the present disclosure relate to an apparatus comprising: a mop block structure comprising an opening, a plurality of swivel connectors attached to a plurality of swivels, and a plurality of rails; a hinged connector comprising a plurality of teeth, a plurality of hinged connector grooves, a hinge portion, a plurality of hinge connecting members, and a rod mating groove; a rod included within a hollow handle; and a sponge structure comprising a sponge secured to a sponge connector, wherein the sponge connector is secured to the hinged connector through the mating of a plurality of ridges located on the sponge connector with the plurality of hinge connecting members, wherein the hinged connector is secured to the mop block structure through the mating of the plurality of hinged connector grooves with the plurality of swivel connectors, wherein the rod is secured to the rod mating groove at one end and to a pressure applying member attached to the hollow handle at the other end.

Aspects of the present disclosure relate to a method comprising: providing a mop block structure comprising an opening, a plurality of swivel connectors attached to a plurality of swivels, and a plurality of rails; providing a hinged connector comprising a plurality of teeth, a plurality of hinged connector grooves, a hinge portion, a plurality of hinge connecting members, and a rod mating groove; providing a rod included within a hollow handle; providing a sponge structure comprising a sponge secured to a sponge connector; and wringing the sponge by moving a pressure applying member from one position to another, wherein the sponge connector is secured to the hinged connector through the mating of a plurality of ridges located on the sponge connector with the plurality of hinge connecting members, wherein the hinged connector is secured to the mop block structure through the mating of the plurality of hinged connector grooves with the plurality of swivel connectors, wherein the rod is secured to the rod mating groove at one end and to the pressure applying member attached to the hollow handle at the other end.

BRIEF DESCRIPTION OF THE DRAWINGS

A more complete understanding of aspects of the present disclosure and the advantages thereof may be acquired by referring to the following description in consideration of the accompanying drawings, in which like reference numbers indicate like features, and wherein.

DETAILED DESCRIPTION

In the following description of the various embodiments, reference is made to the accompanying drawings, which form a part hereof, and in which is shown by way of illustration various embodiments in which the disclosure may be practiced. It is to be understood that other embodiments may be utilized and structural and functional modifications may be made.

Figure 1:
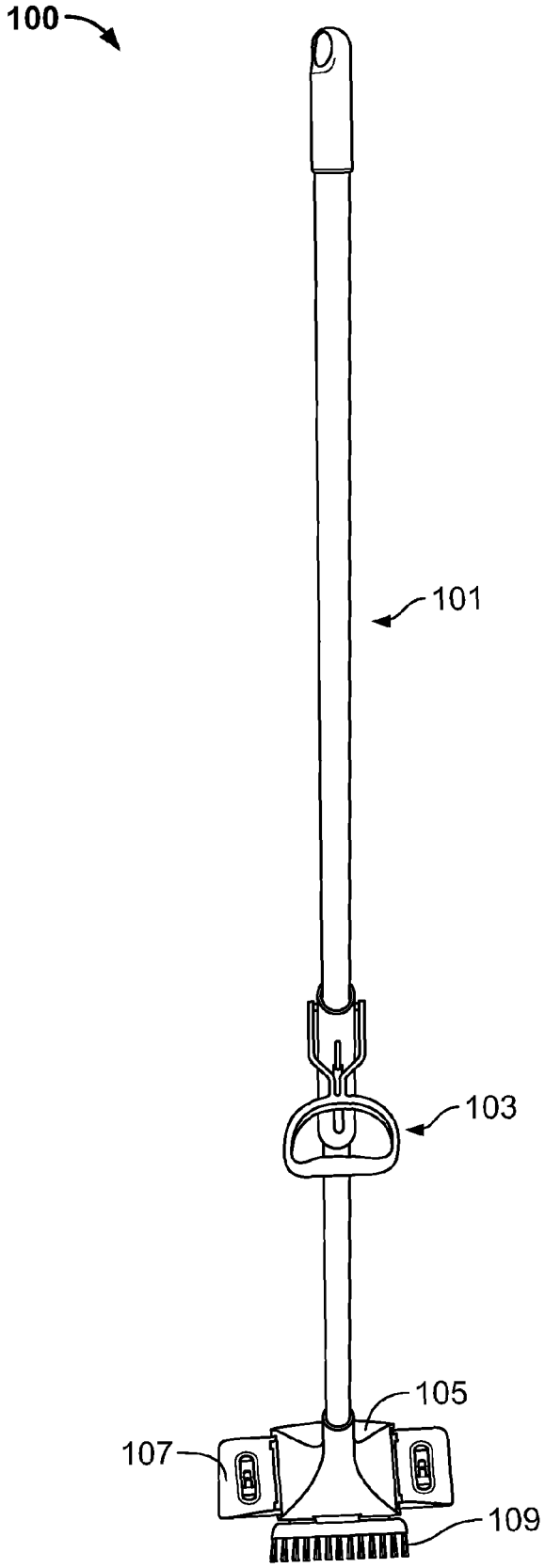
FIG. 1 illustrates a front view of an enhanced sponge mop in accordance with certain aspects of the present disclosure.

FIG. 1 illustrates a front view of an enhanced sponge mop in accordance with at least one aspect of the present disclosure. FIG. 1 shows mop 100 with mop handle 101, pressure applying member 103, mop block structure 105, hinged connector 107, and brush 109. The mop handle 101, pressure applying member 103, mop block structure 105, and hinged connector 107 may be manufactured from various materials, including wood, metal, plastic, etc. In some embodiments, the mop handle 101 may be hollow to allow for the placement of a rod inside the handle 101 so that the pressure applying member 103 may apply pressure to the hinged connector 107, as described in detail below. Also, one of ordinary skill in the art will recognize that side brush 109 may be optional in some embodiments. In these embodiments, the brush 109 may be used as a second cleaning implement (second to a mop sponge attached to the hinged connector 107, as described below) when attached to or detached from mop 100.

Figure 2:
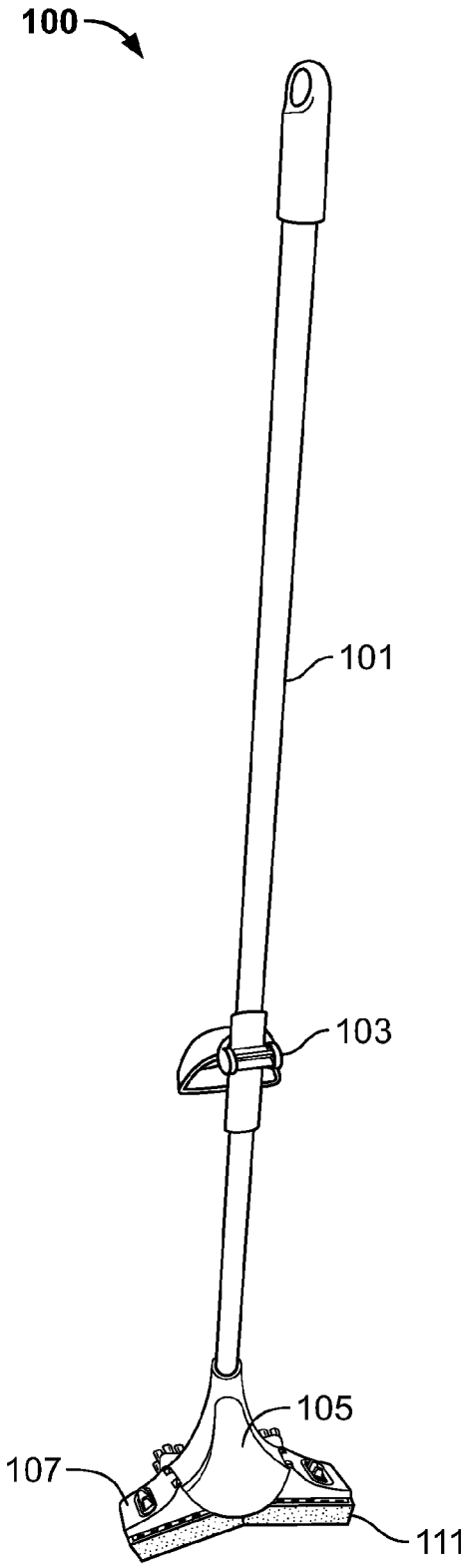
FIG. 2 shows a back view of an enhanced sponge mop in accordance with certain aspects of the present disclosure.

FIG. 2 shows a back view of an enhanced sponge mop in accordance with at least one aspect of the present disclosure. FIG. 2 shows many of the same features as FIG. 1; for instance, FIG. 2 shows mop 100 with mop handle 101, pressure applying member 103, mop block structure 105, and hinged connector 107. FIG. 2 also shows a sponge structure 111 attached to the hinged connector 107. The sponge in sponge structure 111 and the brush 109 may be manufactured from various materials, including cloth, yarn, microfiber, etc.

Figure 3:
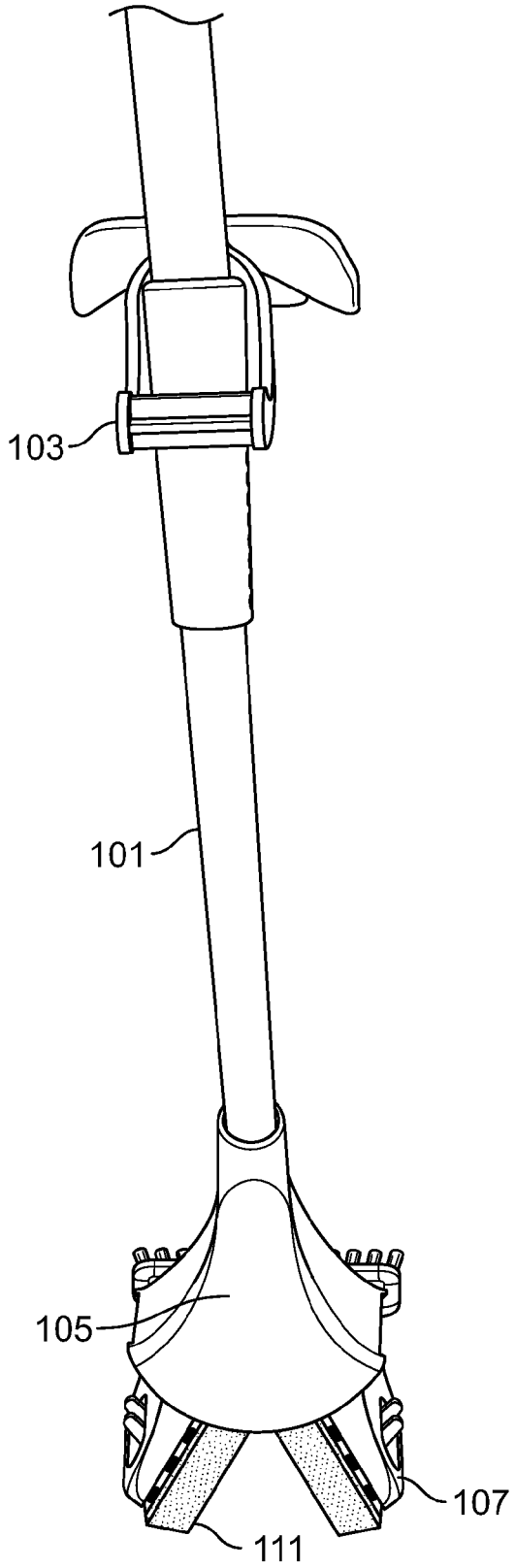
FIG. 3 shows a first close-up view of an enhanced sponge mop with wings closed in accordance with certain aspects of the present disclosure.
Figure 4:
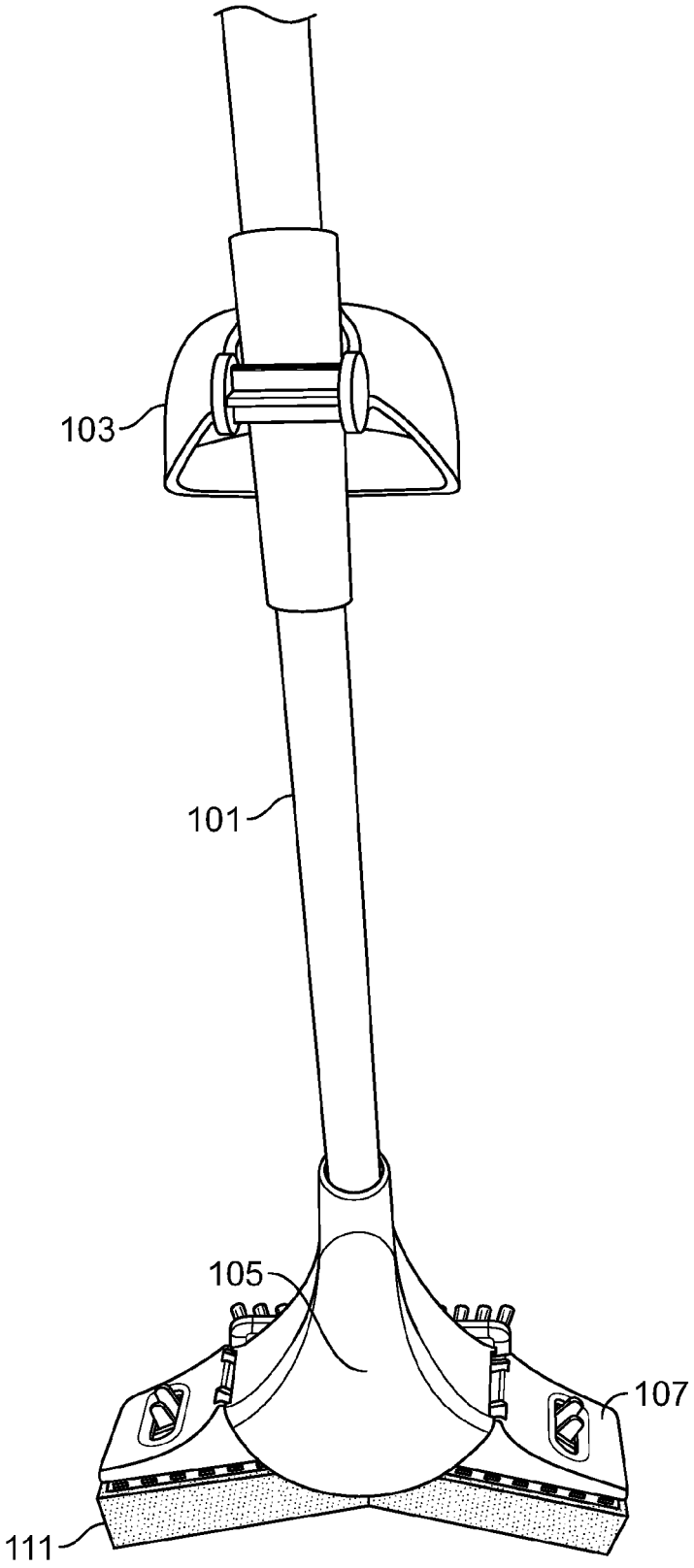
FIG. 4 shows a first close-up view of an enhanced sponge mop with wings open in accordance with certain aspects of the present disclosure.
Figure 5:
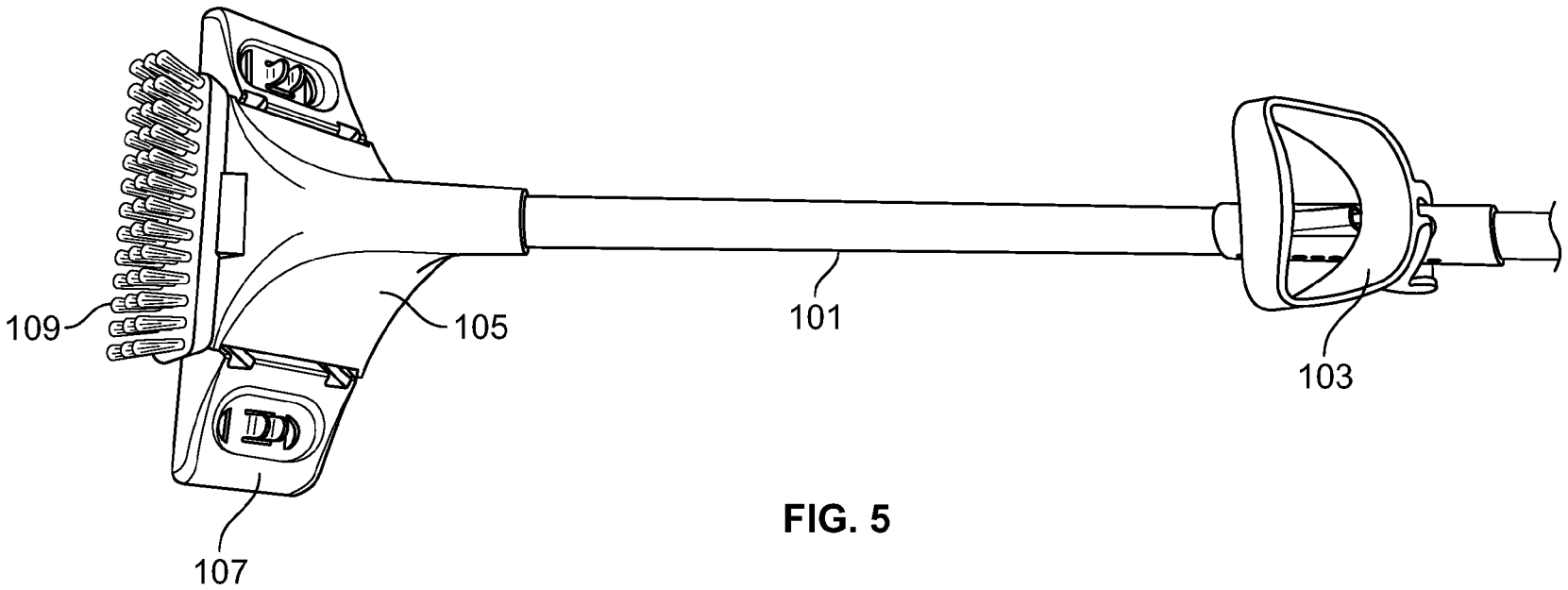
FIG. 5 shows a top-down view of an enhanced sponge mop with wings open in accordance with certain aspects of the present disclosure.
Figure 6:
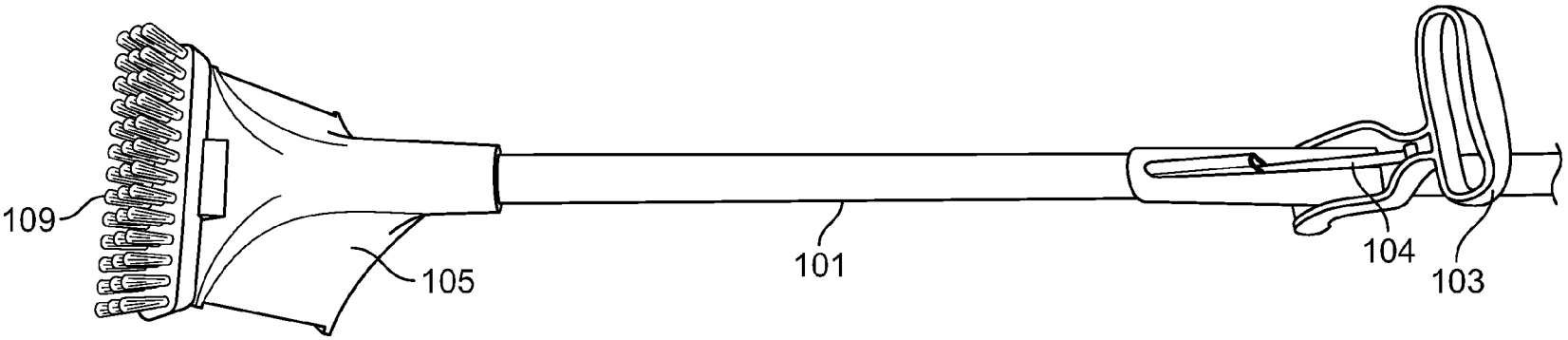
FIG. 6 shows a top-down view of an enhanced sponge mop with wings closed in accordance with certain aspects of the present disclosure.
Figure 7:
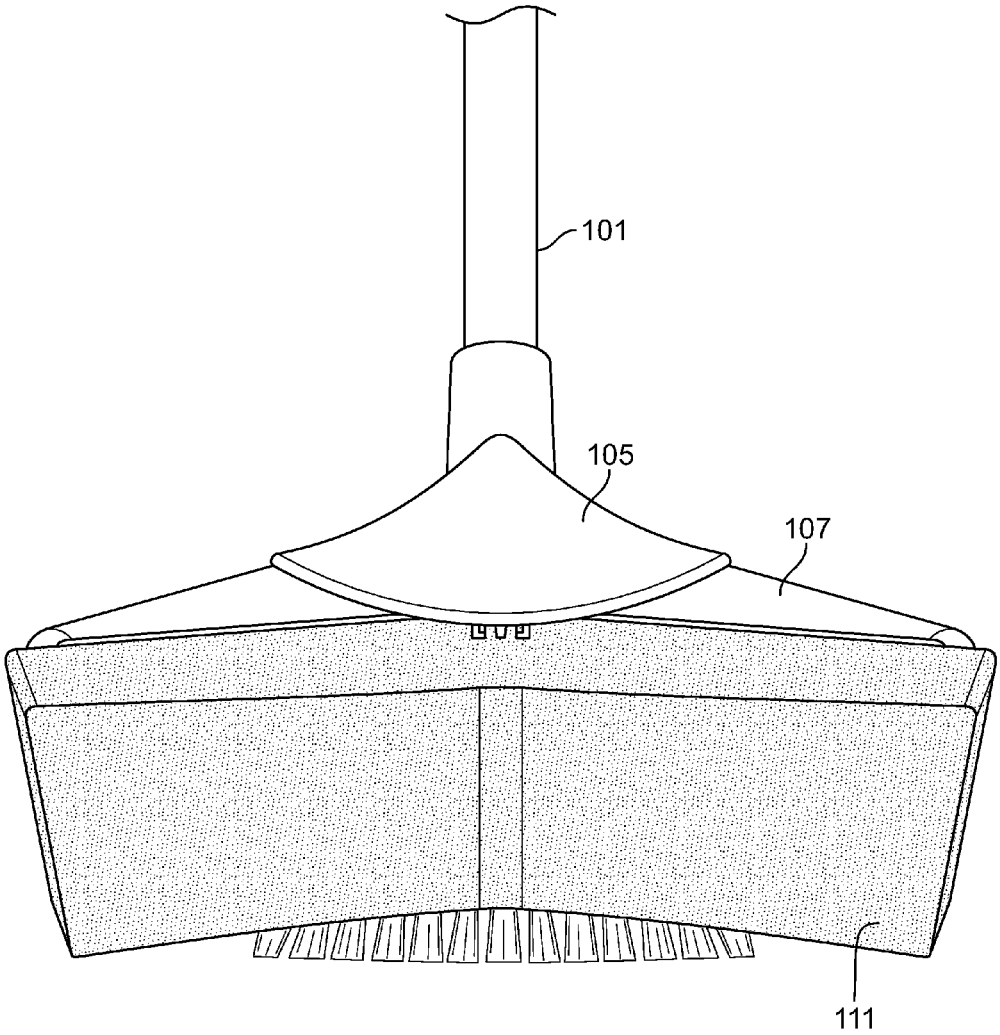
FIG. 7 shows a second close-up view of an enhanced sponge mop with wings open in accordance with certain aspects of the present disclosure.
Figure 8:
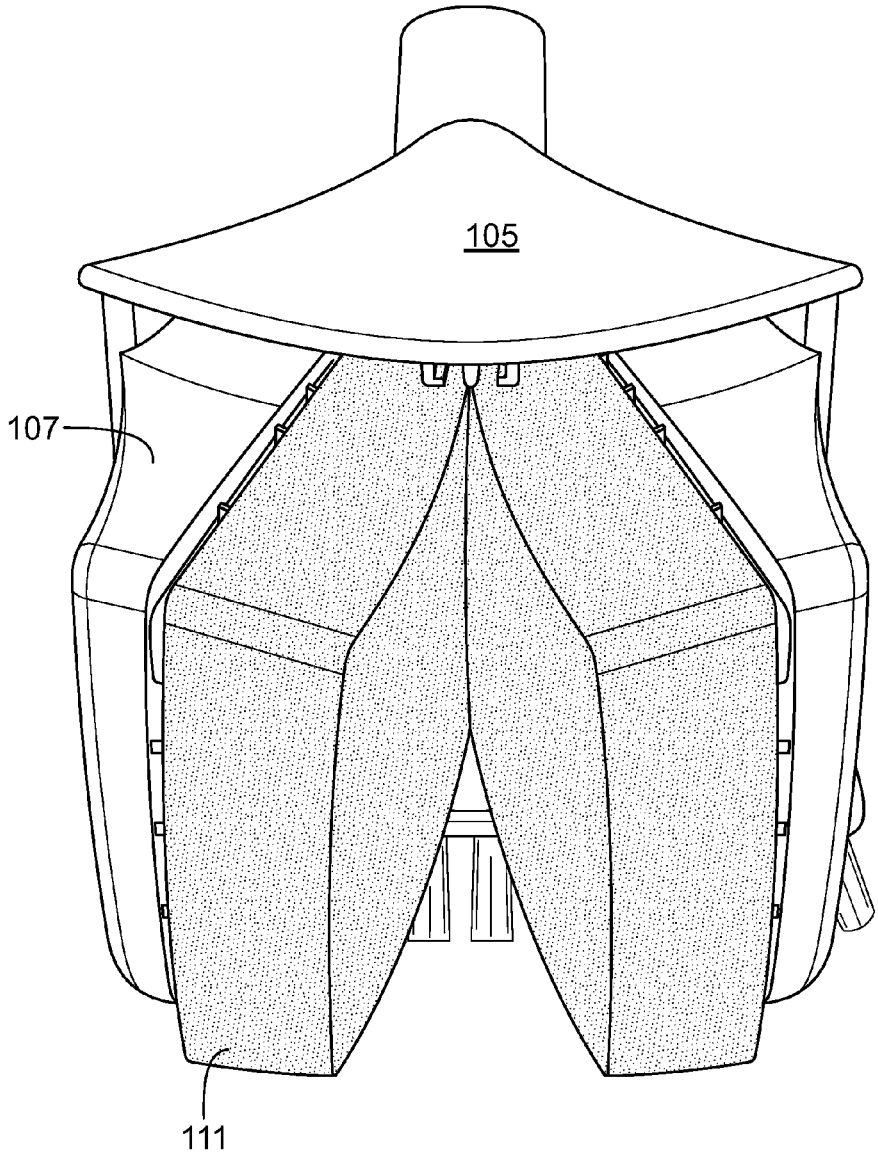
FIG. 8 shows a second close-up view of an enhanced sponge mop with wings closed in accordance with certain aspects of the present disclosure.
Figure 9:
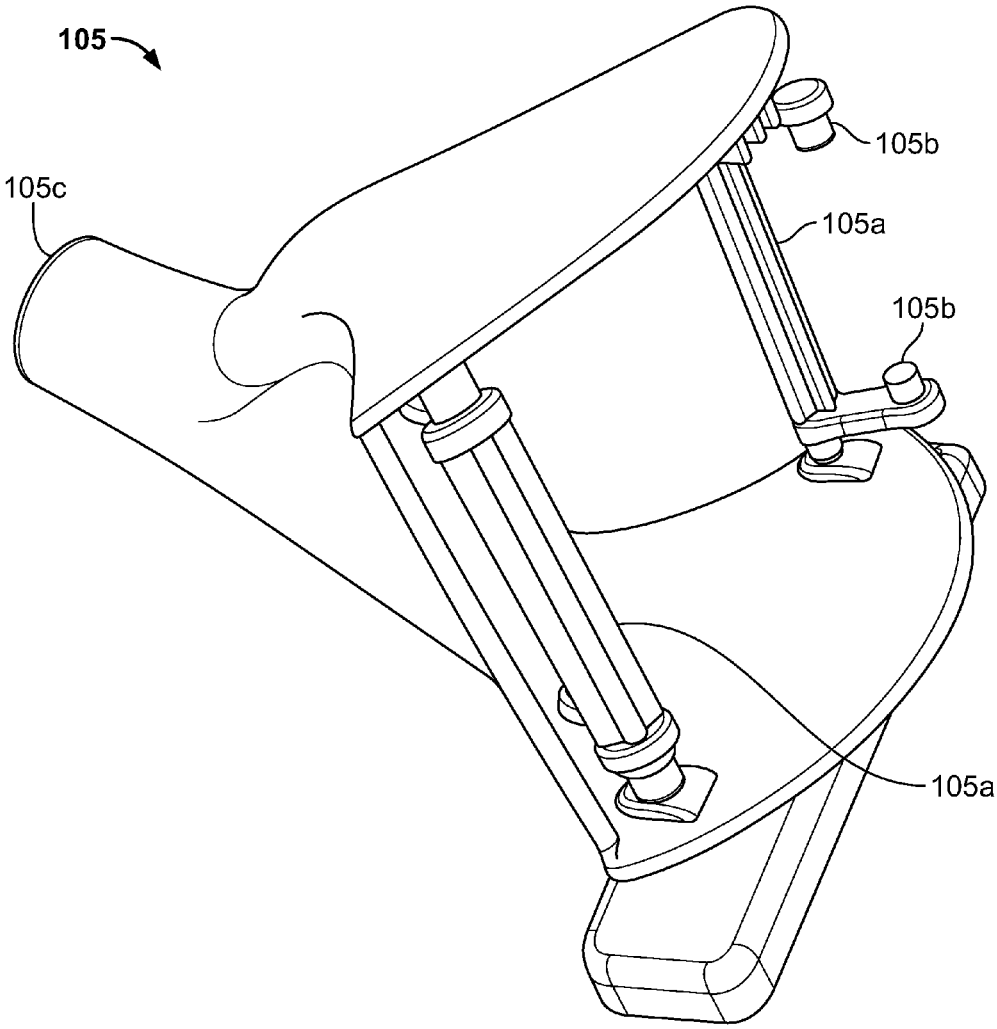
FIG. 9 shows a first perspective view of a mop block structure in accordance with certain aspects of the present disclosure.
Figure 10:
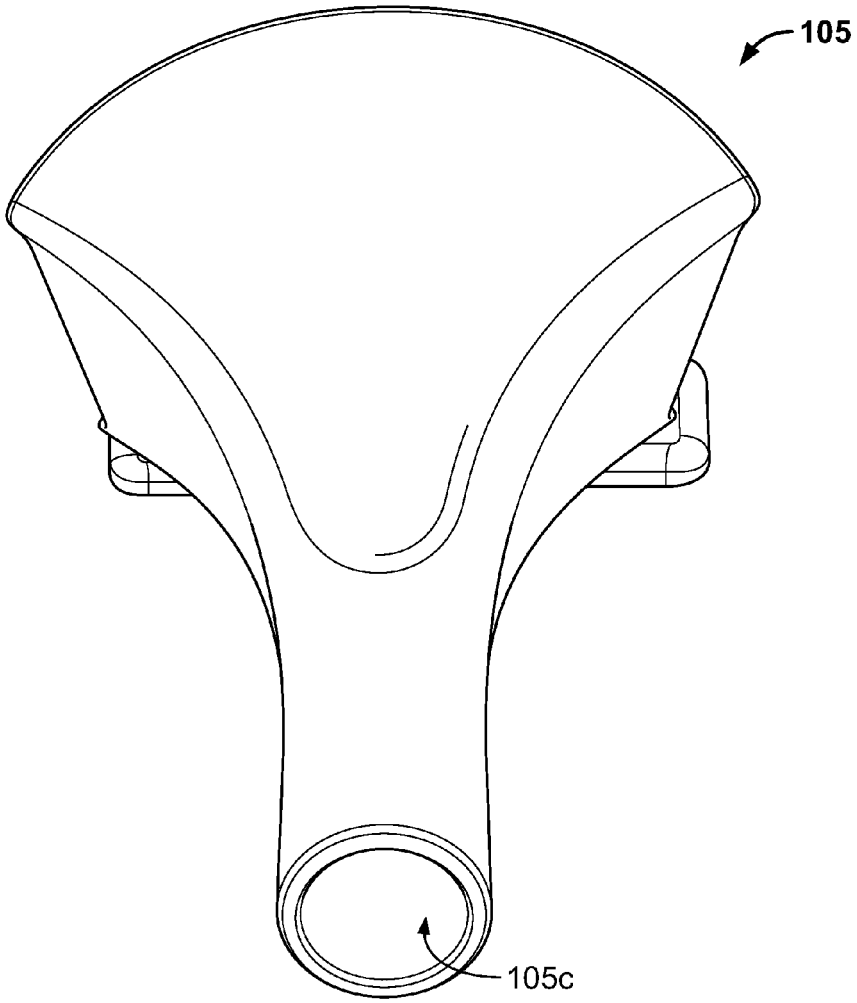
FIG. 10 shows a second perspective view of a mop block structure in accordance with certain aspects of the present disclosure.

FIGS. 3-8 show various views of an enhanced sponge mop with wings moved from a closed position to an open position (and vice versa) in accordance with at least one aspect of the present disclosure. The wings of the mop 100 may refer to portions of the hinged connector 107 to the left and right of the center of the hinged connector 107. As mentioned earlier, the hinged connector 107 may be moved from an open-wing position to a closed-wing position so that a sponge connected to the hinged connector 107 may be wringed of any cleaning solution. To achieve this motion, a rod (e.g., manufactured from metal, plastic, wood, etc.) may be placed in a hollow mop handle 101 to connect pressure applying member 103 with hinged connector 107. The rod may be engaged to hinged connector 107 via a "bent" coupler. The rod may also be bent at both ends to mate properly with the pressure applying member 103 and with the hinged connector 107. For instance, if the pressure applying member 103 is a lever 103 that may be swiveled from top to bottom, the rod may be bent and affixed (e.g., with a "bent coupler," screws, adhesive, by looping the bent rod into a groove within the lever 103 and/or hinged connector 107, etc.) to the lever 103 so that when the lever 103 is moved up, as shown in FIG. 6, the bent rod portion 104 may also move up and be more exposed than when the lever 103 is in the lower position. Similarly, the rod inside handle 101 may be bent at the end that connects with hinged connector 107 to pull the hinged connector 107 to a closed-wing position when the lever 103 is moved up as shown in FIGS. 3, 6, and 8. To allow the rod to mate with the hinged connector 107, the mop block structure 105 may include an opening through which the rod is threaded, as discussed below. In this way, a mop sponge may be wringed without wetting the hands, with little body bending, and without lifting the sponge substantially above the height of a pail or bucket of cleaning solution.

One of ordinary skill in the art would recognize that the pressure applying member may be implemented in various forms. In addition to a lever, the pressure applying member 103 may be implemented as a powered motor, as a slidably-engaged member with mop handle 101, and as a rotatable knob, etc.

FIGS. 9-12 show various perspective views of a mop block structure 105 in accordance with at least one aspect of the present disclosure. As shown in FIGS. 9-12, mop block structure 105 includes swivels 105*a*, swivel connectors 105*b*, top opening 105*c*, bottom opening 105*d*, and rails 105*e*. As mentioned earlier, a rod may be threaded through mop block structure 105 via top opening 105*c* and bottom opening 105*d* so that the rod may mate with hinged connector 107.

Figure 11:
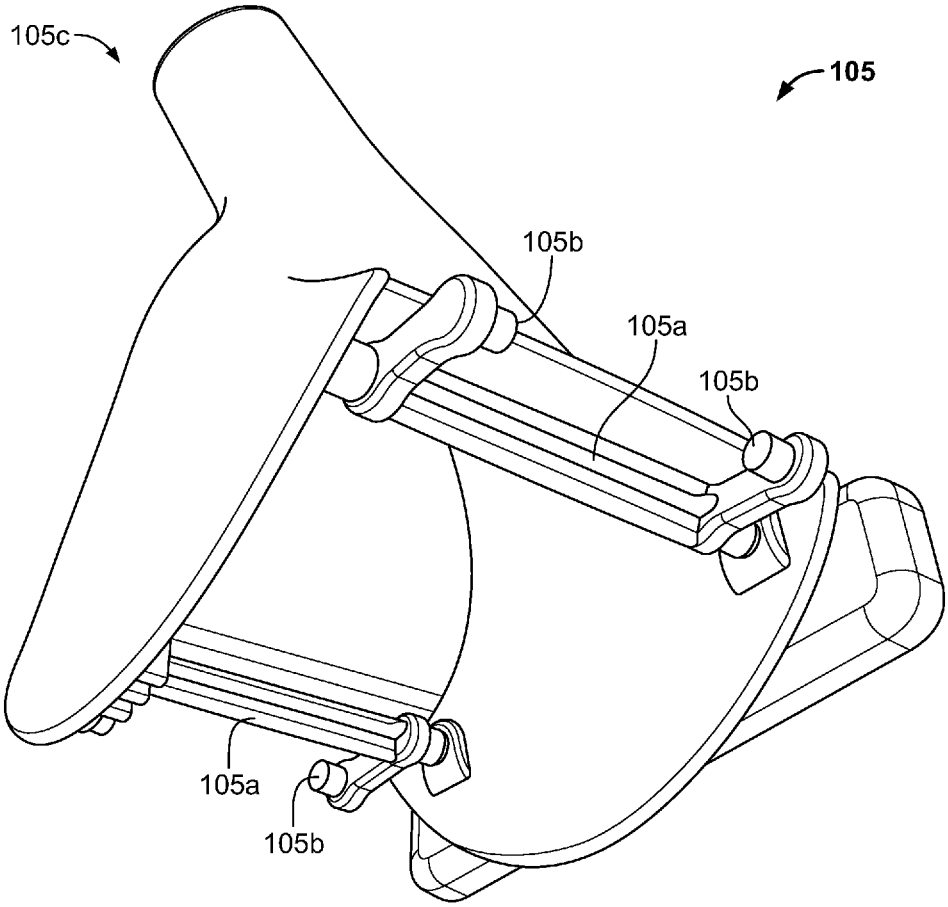
FIG. 11 shows a third perspective view of a mop block structure in accordance with certain aspects of the present disclosure.
Figure 12:
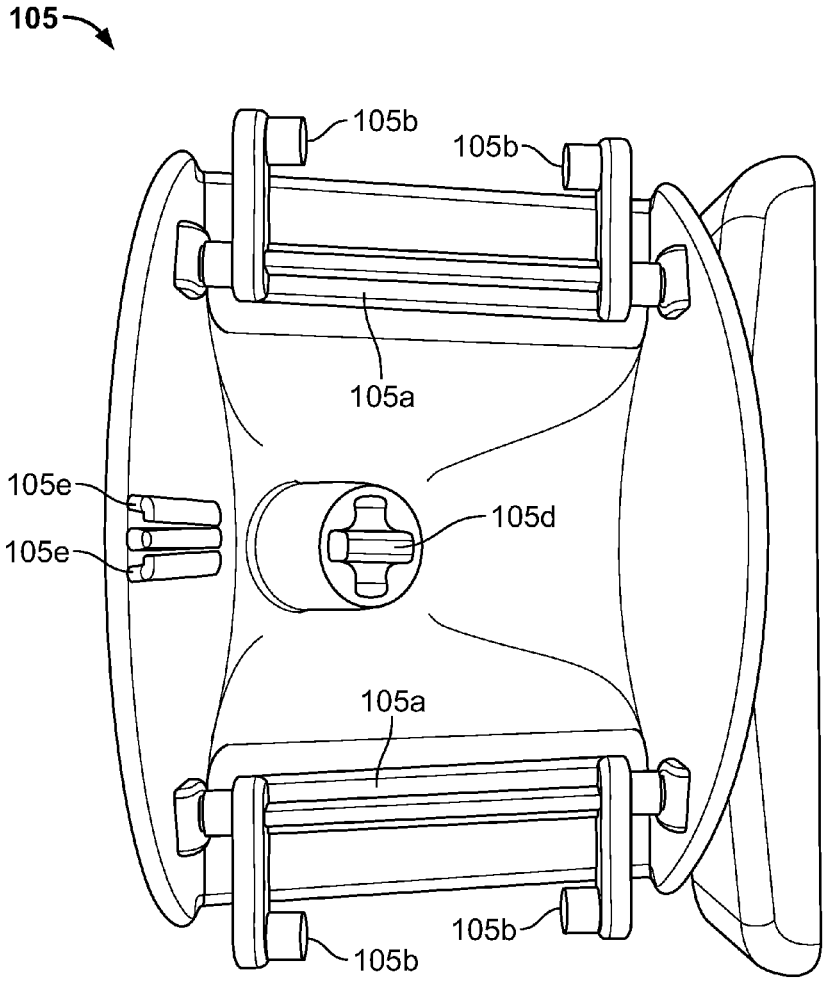
FIG. 12 shows a fourth perspective view of a mop block structure in accordance with certain aspects of the present disclosure.

Moreover, the hinged connector 107 may be secured to mop block structure 105 via swivels 105*a* and swivel connectors 105*b*. Swivels 105*a* may rotate from an open position (as shown in FIGS. 11 and 12) to a closed position, and vice versa, to allow hinged connector 107 to similarly move from an open position to a closed position, and vice versa. Swivel connectors 105*b* located on swivels 105*a* may mate with hinged connector grooves (as discussed below) to secure the mop block structure 105 to hinged connector 107.

In addition, rails 105*e* located on mop block structure 105 may further secure mop block structure 105 to hinged connector 107 by allowing teeth located on hinged connector 107 (described below) to mate with and slide down the rails 105*e*. The rails 105*e* may also add stability to the hinged connector 107 and sponge structure 111, as the hinged connector 107 is moved from an open-wing position to a closed-wing position, and vice versa. Even though FIG. 12 shows rails 105*e* only on one side of mop block structure 105, rails 105*e* may be placed on both sides of mop block structure 105 to add additional stability and support for hinged connector 107 as the hinged connector 107 is moved from an open-wing position to a closed-wing position, and vice versa. Also, although FIG. 12 shows two rails 105*e* on one side of mop block structure 105, any number of rails 105*e* may be placed to add varying levels of stability to hinged connector 107 as hinged connector 107 slides down the rails 105*e*.

Figure 13:
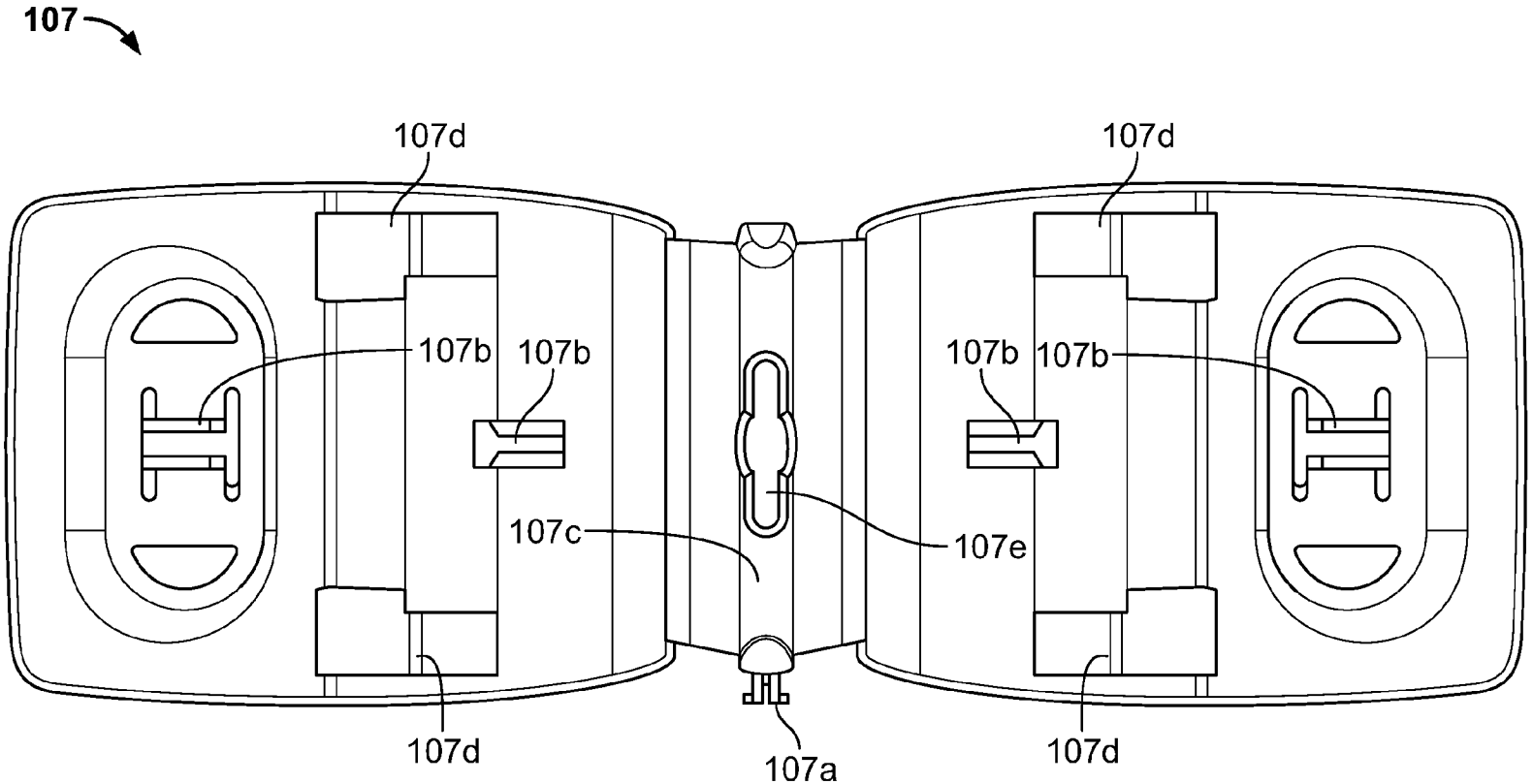
FIG. 13 shows top-down view of a hinged connector in accordance with certain aspects of the present disclosure.
Figure 14:
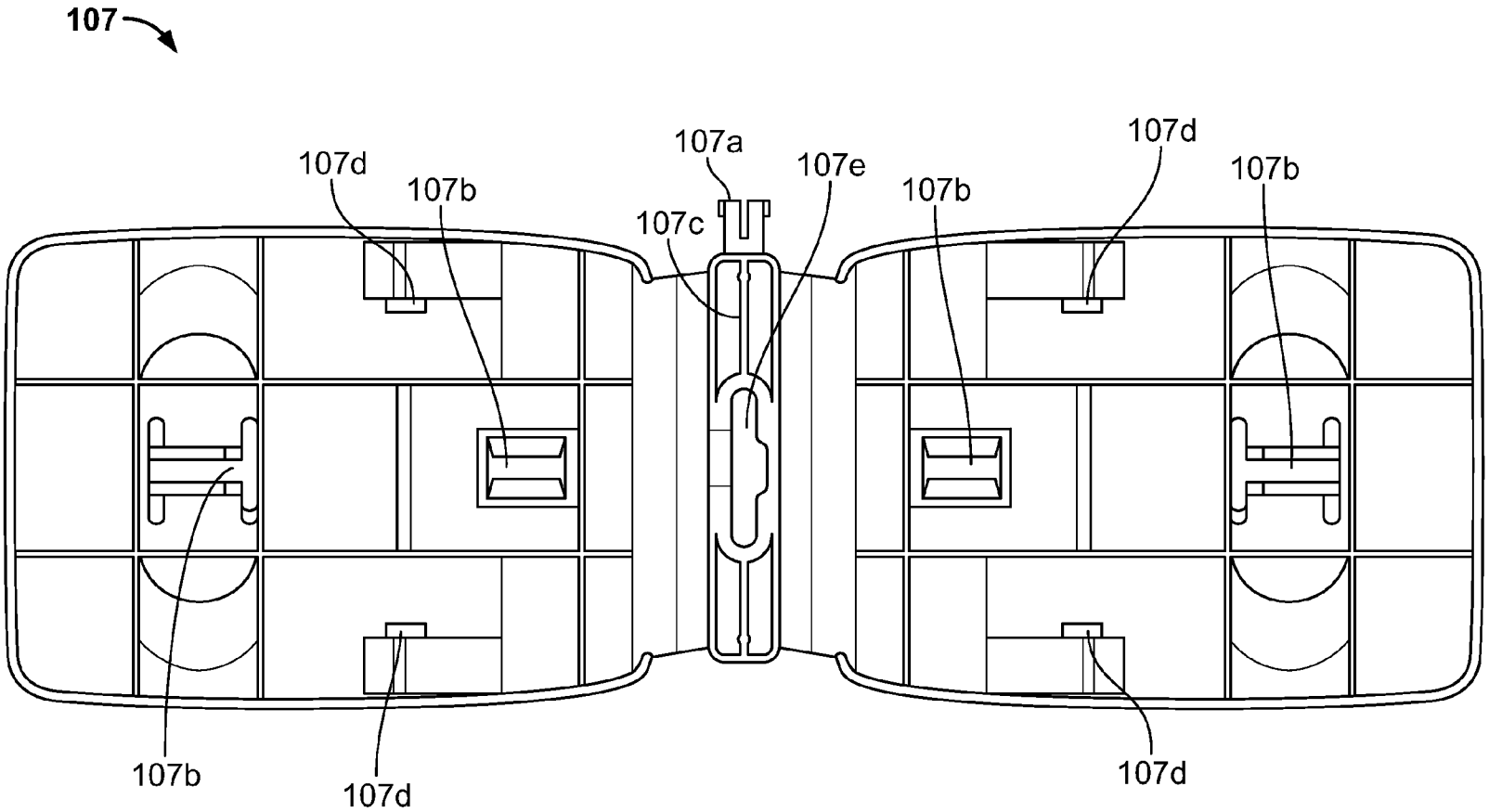
FIG. 14 shows bottom-up view of a hinged connector in accordance with certain aspects of the present disclosure.

FIGS. 13-14 show a top-down view and a bottom-up view of a hinged connector 107, respectively, in accordance with at least one aspect of the present disclosure. As shown in FIGS. 13-14, the hinged connector may include teeth 107*a*, hinge connecting members 107*b*, hinge portion 107*c*, hinged connector grooves 107*d*, and rod mating groove 107*e*. As discussed above, teeth 107*a* may function to add stability and support to hinged connector 107 as teeth 107*a* slide down the rails 105*e* to allow hinged connector 107 to move from an open-wing position to a closed-wing position, and vice versa. Even though FIGS. 13-14 depict two teeth 107*a* on one side of hinged connector 107, any number of teeth 107*a* in various locations may be included as part of hinged connector 107.

Hinge connecting members 107*b* may function to attach hinged connector 107 to sponge structure 111 by allowing the hinged connector 107 to clip onto ridges located on a sponge connector, as described below. One of ordinary skill in the art would recognize that hinge connecting members 107*b* may be implemented in various forms. For instance, hinge connecting members 107*b* may be implemented as clips, adhesive surfaces, and screws, among other things.

Hinge portion 107*c* may allow hinged connector 107 to function as a living hinge, as the areas to the left and right of the hinge portion 107*c* (e.g., the wings of hinged connector 107) may be configured to bend around the hinge portion 107*c*. The wings of hinged connector 107 may be configured to bend in various ways. For instance, if hinged connector 107 is implemented as a plastic part, a portion of the hinged connector 107 immediately to the left and right of hinge portion 107*c* may be manufactured as a thin plastic section that allows the hinged connector 107 to bend easily at the thin plastic section. In other embodiments, hinged connector 107 may include mated joints that allow the hinged connector 107 to swivel around the joint.

Hinged connector grooves 107*d* may mate with swivel connectors 105*b* to allow the mop block structure 105 to be secured with the hinged connector 107. In addition, rod mating groove 107*e* may secure a rod that connects with pressure applying member 103 to the hinged connector 107. As mentioned previously, the rod may be bent (e.g., in the form of a hook) or may be otherwise secured (e.g., via screws, adhesive, etc.) to the rod mating groove 107*e* of hinged connector 107.

Figure 15:
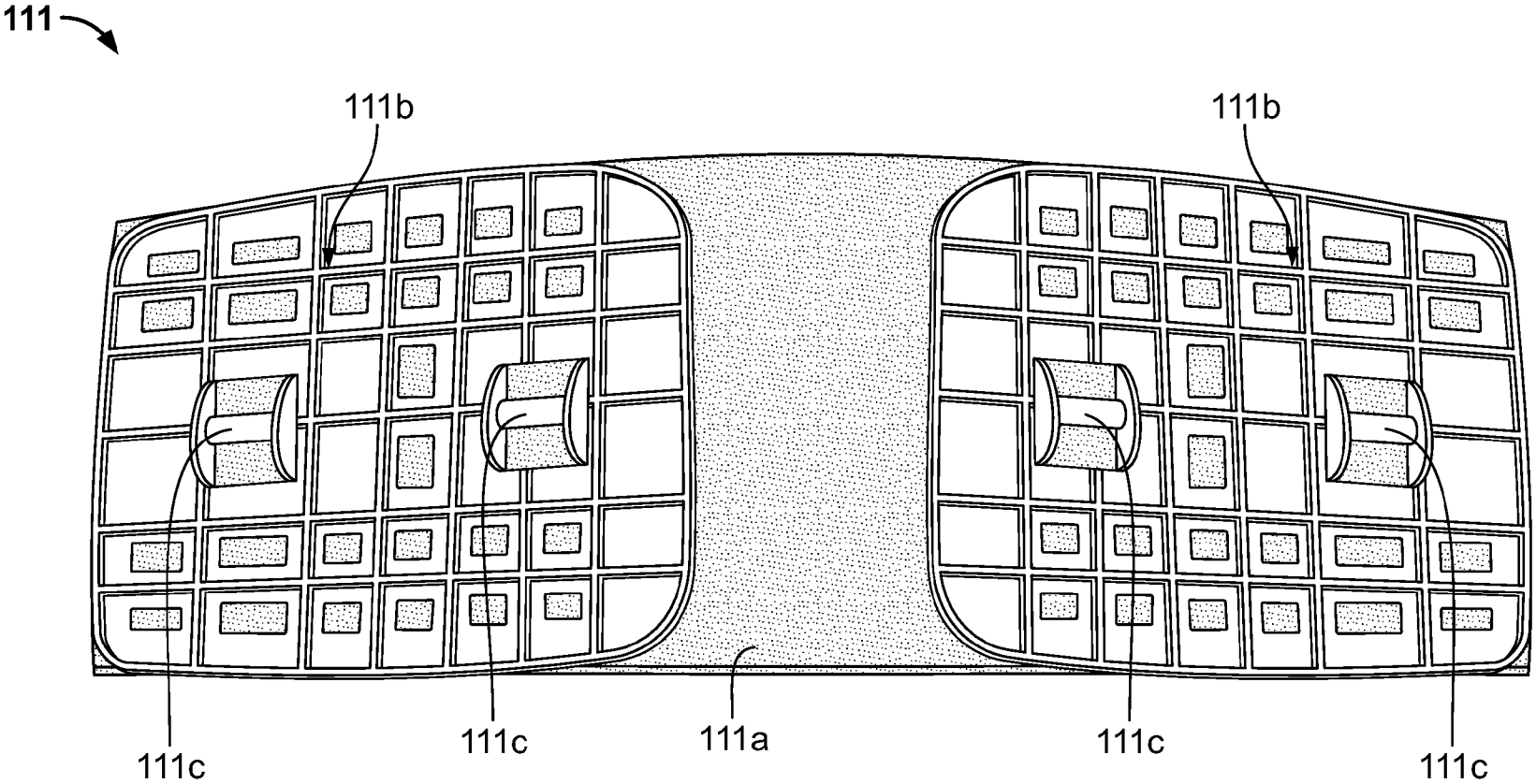
FIG. 15 shows top-down view of sponge with a sponge connector in accordance with certain aspects of the present disclosure.

FIG. 15 shows top-down view of sponge 111*a* attached to a sponge connector 111*b* in accordance with at least one aspect of the present disclosure. The sponge structure 111 shown in FIG. 15 includes a sponge 111*a*, sponge connector 111*b*, and ridges 111*c*. The sponge 111*a* may be attached to sponge connector 111*b* through various techniques, including through the use of adhesives, heat, staples, etc. Ridges 111*c* located on sponge connector 111*b* may function to mate with hinge connecting members 107*b* of hinged connector 107.

Figure 16:
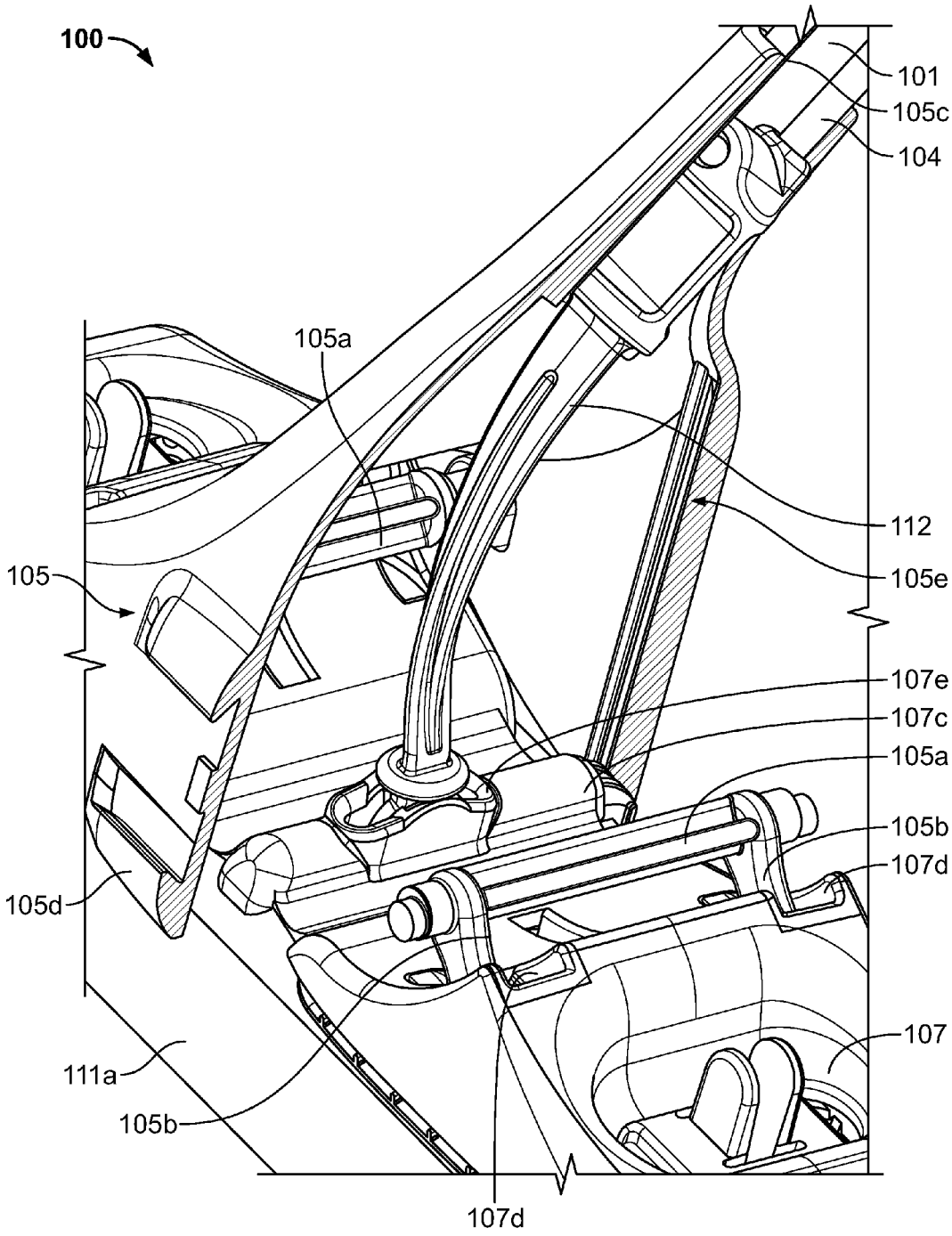
FIG. 16 shows a cross-sectional view of an enhanced sponge mop in accordance with certain aspects of the present disclosure.

FIG. 16 shows a cross-sectional view of enhanced sponge mop 100 in accordance with certain aspects of the present disclosure. Enhanced sponge mop 100 includes mop block structure 105 (cross-sectioned in FIG. 16 for illustrative purposes) having swivels 105*a*, swivel connectors 105*b*, top opening 105*c*, bottom opening 105*d*, and rails 105*e*. Enhanced sponge mop 100 also includes hinged connector 107 having hinge portion 107*c*, hinged connector grooves 107*d*, and rod mating groove 107*e*. Enhanced sponge mop 100 further includes bent rod portion 104, hollow mop handle 101 and sponge 111*a*.

In FIG. 16, a rod engages on its proximal end to hinged connector 107 via rod coupler 112 and is effectively a bent rod portion 104. Bent rod portion 104 also engages to pressure applying member 103 on its distal end. To wring sponge 111*a*, pressure applying member 103 is moved distally and axially relative to hollow mop handle 101. This movement causes rod coupler 112, which is engaged to hinged connector 107 at rod mating groove 107*e*, to "pull" hinged connector 107. Meanwhile, hinge portion 107*c* bends because swivels 105*a* remain static, although swivel connectors 105*b* pivot. The net effect is that sponge 111*a* is folded over against itself and wrung. As pressure applying member 103 is returned to its initial position, so too does sponge 111*a* via the reverse of the previously described process.

Rod coupler 112 may connect to a rod via many methods, such as bending the rod at a right angle as shown in FIG. 16. Rod coupler 112 may be manufactured from flexible plastic so as to improve performance and "feel" to the user (alternatively, rod coupler 112 may be manufactured from very hard plastic or other similar inflexible materials).

While illustrative apparatuses and methods as described herein embodying various aspects of the present disclosure are shown, it will be understood by those skilled in the art, that the disclosure is not limited to these embodiments. Modifications may be made by those skilled in the art, particularly in light of the foregoing teachings. For example, each of the elements of the aforementioned embodiments may be utilized alone or in combination or subcombination with elements of the other embodiments. It will also be appreciated and understood that modifications may be made without departing from the true spirit and scope of the present disclosure. The description is thus to be regarded as illustrative instead of restrictive on the present disclosure.

What is claimed is:

1. An apparatus comprising:

a mop block structure comprising at least one opening, a plurality of swivel connectors attached to a plurality of swivels, and a plurality of rails;

a hinged connector comprising a plurality of teeth, a plurality of hinged connector grooves, a hinge portion, a plurality of hinge connecting members, and a rod mating groove, wherein the plurality of teeth are configured to mate with the plurality of rails on the mop block structure;

a rod included within a hollow handle; and a sponge structure comprising a sponge secured to a sponge connector.

2. The apparatus of claim 1, wherein the sponge connector is secured to the hinged connector through mating of a plurality of ridges located on the sponge connector with the plurality of hinge connecting members.

3. The apparatus of claim 1, wherein the hinged connector is secured to the mop block structure through mating of the plurality of hinged connector grooves with the plurality of swivel connectors.

4. The apparatus of claim 1, wherein the rod is secured to the rod mating groove at one end and to a pressure applying member attached to the hollow handle at the other end.

5. The apparatus of claim 4, wherein the pressure applying member comprises a lever configured to move from a lower position to an upper position to allow the sponge to be wrung.

6. The apparatus of claim 5, wherein the hinged connector is configured to move from an open-wing position to a closed-wing position and vice versa when the lever is moved from the lower position to the upper position and vice versa.

7. The apparatus of claim 1, further comprising: a brush attached to a side of the mop block structure.

8. The apparatus of claim 1, wherein the plurality of swivels are configured to rotate from an open position to a closed position to allow the hinged connector to move from an open-wing position to a closed-wing position.

9. The apparatus of claim 1, wherein the rod is threaded through the mop block structure via a top opening and a bottom opening in the mop block structure so that the rod mates with the rod mating groove on the hinged connector.

10. The apparatus of claim 1, wherein the plurality of rails are configured to add stability to the hinged connector and the sponge structure when the hinged connector is moved from an open-wing position to a closed-wing position and vice versa.

11. The apparatus of claim 1, wherein the plurality of teeth are configured to slide down the plurality of rails when the hinged connector is moved from the open-wing position to the closed-wing position.

12. The apparatus of claim 1, wherein the plurality of hinge connecting members are chosen from the group consisting of: clips, adhesive surfaces, and screws.

13. The apparatus of claim 1, wherein areas immediately to the left and right of the hinge portion are manufactured as thin plastic sections to allow the hinged connector to bend at the thin plastic sections.

14. A method comprising:

providing a mop block structure comprising an opening, a plurality of swivel connectors attached to a plurality of swivels, and a plurality of rails;

providing a hinged connector comprising a plurality of teeth, a plurality of hinged connector grooves, a hinge portion, a plurality of hinge connecting members, and a rod mating groove, wherein the plurality of teeth are configured to mate with the plurality of rails on the mop block structure;

providing a rod included within a hollow handle;

providing a sponge structure comprising a sponge secured to a sponge connector; and wringing the sponge by moving a pressure applying member from one position to another.

15. The method of claim 14, wherein the sponge connector is secured to the hinged connector through mating of a plurality of ridges located on the sponge connector with the plurality of hinge connecting members.

16. The method of claim 14, wherein the hinged connector is secured to the mop block structure through mating of the plurality of hinged connector grooves with the plurality of swivel connectors.

17. The method of claim 14, wherein the rod is secured to the rod mating groove at one end and to the pressure applying member attached to the hollow handle at the other end.

* * * * *